United States Patent [19]

Lippmaa et al.

[11] 4,237,444

[45] Dec. 2, 1980

[54] HEAVY-DUTY PRECISION WIRE-WOUND ALTERNATING-CURRENT RESISTOR AND METHOD OF MAKING

[76] Inventors: Endel T. Lippmaa, ulitsa Sybra, 14, kv. 2; Vambola I. Roose, ulitsa Ryannaku, 3, kv. 4, both of Tallin, U.S.S.R.

[21] Appl. No.: 20,083

[22] Filed: Mar. 13, 1979

[51] Int. Cl.[3] ..... H01C 1/02; H01C 3/14

[52] U.S. Cl. ..... 338/270; 29/610 R; 338/299

[58] Field of Search ..... 338/270, 267, 296, 299, 338/302, 304, 315, 320, 53, 55; 29/610; 336/58, 60

[56] References Cited

U.S. PATENT DOCUMENTS

| | | | |
|---|---|---|---|
| 2,464,820 | 3/1949 | Livera | 29/610 X |
| 2,685,016 | 7/1954 | Blackburn | 338/269 |
| 2,817,738 | 12/1957 | Kohler | 338/321 X |
| 2,844,692 | 7/1958 | Berkelhamer | 29/610 X |
| 3,051,922 | 8/1962 | Julie | 29/613 X |

FOREIGN PATENT DOCUMENTS

| | | | |
|---|---|---|---|
| 716989 | 8/1965 | Canada | 338/299 |

*Primary Examiner*—C. L. Albritton

*Attorney, Agent, or Firm*—Lackenbach, Lilling & Siegel

[57] ABSTRACT

A heavy-duty precision wire-wound alternating-current resistor comprises a capsule filled with a liquid dielectric formed of a low-viscosity liquid perfluorinated organic compound. Within the capsule of the resistor there is arranged a sectionalized bobbin made from a dielectric material chemically resistant to the liquid perfluorinated organic compound. The sectionalized bobbin carries a resistance element with a clearance therebetween dimensioned so as to exceed by at least an order of magnitude the change in the bobbin diameter due to the magnitude of thermal expansion of the material of the sectionalized bobbin in order to provide the circulation of the liquid dielectric therein. A method of making said heavy-duty precision wire-wound alternating-current resistor comprises the steps of coating the sectionalized bobbin with a layer of a sublimable substance; winding a high-resistance insulated wire, forming the resistance element, onto the sectionalized bobbin; subsequently removing the layer of said sublimable substance by means of vacuum treatment, providing thereby said clearance between the sectionalized bobbin and the resistance element; and filling the capsule of the resistor with the liquid dielectric.

15 Claims, 5 Drawing Figures

HEAVY-DUTY PRECISION WIRE-WOUND ALTERNATING-CURRENT RESISTOR AND METHOD OF MAKING

FIELD OF THE INVENTION

The present invention relates generally to the circuit components of electronic measuring instruments and; more particularly, to heavy-duty precision wire-wound alternating-current resistors apparatus and to methods of making the same.

The invention may find an extensive scope of applications in various high-precision electronic measuring facilities. Particularly advantageous utility can be derived from the resistor of the present invention by employing it in the input circuits of alternating-current voltmeters, in high power voltage dividers, as well as in the capacity of a thermoconverter series resistance element in metrological units intended for the purpose of calibration of alternating-current voltmeters.

BACKGROUND OF THE INVENTION

It is a matter of common knowledge that fairly stringent requirements are being currently imposed on the precision parameters of electronic measuring equipment. It appears to be quite evident that high-precision electronic measuring equipment can be manufactured with the use of resistors concurrently exhibiting high performance attributes. The most important attributes characterizing alternating-current resistors are as follows: power rating, accuracy, time stability, temperature coefficient of resistance, operating temperature range, operating voltage, frequency error, and overall dimensions. Heavy-duty precision wire-wound alternating-current resistors are also expected to have an adequate degree of technological effectiveness which is rather essential to their full-scale production.

An examination of present-day patent, scientific and technical, as well as advertising, publications reveals that heavy-duty wire-wound alternating-current resistors incorporating all of the performance attributes stated hereinabove, so that each of them is sufficiently high, do not exist in the contemporary state of the art. Among the available heavy-duty alternating-current resistors one is confronted with the inevitable option of having one or two satisfactory parameters while the rest are low.

There are a variety of configurations of heavy-duty alternating-current resistors providing high single parameters.

DESCRIPTION OF THE PRIOR ART

In particular, known in the art is a resistor (see U.S.S.R. Author's Certificate No. 381104) comprising a cylindrical resistance element arranged in a casing. Secured in the casing and spaced some distance apart there are two iris diaphragms joined by a common holder enabling the synchronous opening of the diaphragms. In the gap between the diaphragms there is located a shield consisting of a sheet of resilient metal foil rolled in the form of a cylinder with a spiral guide. The distributed capacitance of the resistance element to the shield is controlled by said diaphragms enclosing it. After adjusting the resistor to a minimum frequency error, the holder is fixed in a given position.

The above resistor furnishes a decrease in frequency error. However, in order to uprate this prior art resistor it is necessary to enlarge the overall dimensions of the resistance element, i.e. to enlarge the overall dimensions of the resistor as a whole. Thermal expansion of the components of the resistor in operation will unavoidably impair its time stability. Furthermore, the intricate structure of the resistor precludes its fabrication in a small size. It is therefore apparent from the aforesaid that the method of its making is complex and laborious.

Known in the prior art is a resistor (see Author's Certificate No. 449381) partially obviating the disadvantages of the resistor considered hereinabove and comprising a frame with a sectionalized resistance element wound thereon. Each section of the resistive element is designed in the form of a spiral. The distance between the sections defines the value of spurious capacitance of the resistive element. An increase in the distance between the sections involves a decrease in the value of stray capacitance, that is, a decrease in frequency error. This, however, entails a more cumbersome structure of the resistor. The sections of the resistance element designed in the form of a spiral are provided with a developed lateral surface, which improves the cooling of the resistance element contributing thereby to an increase in the power rating of the resistor. Again, as in the previously mentioned case, in order to uprate the resistor it is necessary to enlarge the diameter of the resistance element sections, i.e. to enlarge the overall dimensions of the resistor as a whole. It should be also noted that the sectional spiral microwire winding procedure and the procedure of securing the microwire in this particular position are highly precarious. Hence, the method of making such a resistor is complex and tedious.

There is also known a high-power precision wire-wound alternating-current resistor and a method of making the same (see U.S. Pat. No. 3,104,311), which partly eliminates the disadvantages of the aforementioned resistors. This prior art resistor comprises an epoxy resin capsule filled with transformer oil acting as a liquid dielectric material. Inside the capsule there is arranged a sectionalized bobbin, also formed of epoxy resin and having a resistance element wound thereon. The resistance element features a high-resistance winding of insulated wire having a diameter of the order of 50 microns. The resistor is fabricated by winding the wire onto the sectionalized bobbin and further filling the inside cavity of the capsule with transformer oil.

Time stability of the above resistor is provided through the selection of a suitable wire material. An increase in the power rating is secured through the agency of transformer oil utilized as a coolant. The resistor is compact. However, the resistor's time stability is adversely affected by the substantial thermal expansion of the sectionalized bobbin manufactured from plastics, which has a mechanical impact on the thin wire of the resistance element bringing about a change in its resistance. Due to the employment of glass reinforced plastics for the bobbin and transformer oil for the liquid dielectric material, both of which have a large value of the loss factor tan $\alpha$, the resistor fails to provide a small frequency error. What is more, the resistor fails to provide high power ratings, which is caused by the following:

transformer oil tends to cool only the external surface of the resistance element winding;

transformer oil has a high degree of viscosity and therefore the removal of heat from the resistance element by natural convection is rendered difficult; and the plastic capsule displays a low degree of heat conduction and therefore the removal of heat from transformer oil to the environment is rendered difficult.

Thus, a consideration of the abovedescribed prior art resistors and methods of fabrication indicates that none of them is capable of supplying all of the basic parameters at an equally high level and at the same time. The provision of some single high parameters is attained at the cost of penalizing the rest of them. This fact is attributable to their design philosophy, basic contradictions in the physical, chemical and mechanical properties peculiar to the materials of the components as well as the methods of fabrication thereof.

SUMMARY OF THE INVENTION

It is an object of the present invention to provide a heavy-duty precision wire-wound alternating-current resistor exhibiting equally high major electric parameters in a simultaneous fashion.

Another object of the present invention is to provide a resistor featuring high reliability and long life.

Still another object of the present invention is to provide a resistor of small size for electronic circuit applications.

A further object of the present invention is to provide a simple, technologically effective method of full-scale production of a heavy-duty precision wire-wound alternating-current resistor.

With these and other objects in view, there is provided a heavy-duty precision wire-wound alternating-current resistor comprising a capsule filled with a liquid dielectric, and a sectionalized bobbin of insulating material disposed therein and carrying a resistance element designed in the form of a high-resistance insulated wire winding. According to the invention, the resistance element is arranged on the sectionalized bobbin with a clearance being dimensioned so as to exceed by at least an order of magnitude the change in the bobbin diameter due to the thermal expansion of the material of the bobbin in order to provide the circulation of the liquid dielectric formed of a low-viscosity liquid perfluorinated organic compound. The sectionalized bobbin is made from a material chemically resistant to the liquid perfluorinated organic compound.

The clearance provided between the resistance element and the sectionalized bobbin completely eliminates the development of mechanical stresses in the wire of the resistance element when the bobbin inevitably expands under the effect of heating, irrespective of the fact whether such expansion occures due to an increase in the ambient temperature or to the heat evolved by the resistance element.

This feature ensures the provision of a high level of time stability of the resistor, inasmuch as a variation in the resistance value of the resistance element due to the mechanical influence of the bobbin is excluded. Furthermore, the clearance between the resistance element and the bobbin ensures the circulation of the liquid dielectric around the entire surface of the resistance element as distinguished from the prior art resistors having their resistance elements designed in the form of a high-resistance wire winding tightly wound onto the sectionalized bobbin. This secures an increase of cooling of the resistance element surface. The circulation in the clearance between the resistance element and the bobbin of the liquid dielectric, in the form of a low-viscosity liquid perfluorinated organic compound, provides an improved dissipation capacity of the resistance element through its intensive cooling. Apart from having high thermal characteristics from a physical standpoint, the liquid perfluorinated organic compounds also offer high electric characteristics, which in conjunction with the proposed design of the resistor endows it with a possibility of reaching the required high electrical parameters simultaneously. The liquid perfluorinated organic compounds are agressive to many insulating materials, which is the reason why the sectionalized bobbin is manufactured from a material chemically resistant to these compounds.

It is advisable that the liquid perfluorinated organic compound be comprised of a mixture of perfluoro-n-butyl-tetrahydrofuran and perfluoro-n-propyl-pyran.

It is also advisable that the liquid perfluorinated organic compound be comprised of perfluoro-di-n-butyl ether.

The employment of said mixture of perfluoro-n-butyl-tetrahydro-furan and perfluoro-n-propyl-pyran, or perfluoro-di-n-butyl ether, both having a low degree of viscosity, the liquid perfluorinated organic compound ensures the perfect cooling of the resistance element, thus enhancing the power rating of the resistor. The above specified perfluorinated organic compounds have boiling temperatures considerably in excess of the operating temperature range of the resistor, which results in the absence of an inadmissible pressure within the capsule of the resistor upon its operation. This enables the use of a thin-walled capsule, thereby decreasing the weight and dimensions of the resistor together with improving the transfer of heat being evolved by the resistance element to the environment. The mixture of perfluoro-n-butyl-tetrahydro-furan and perfluoro-n-propyl-pyran as well as perfluoro-di-n-butyl ether features remarkably high insulating properties providing a high-performance resistance element. As a consequence, the resistor possesses a high breakdown voltage. Moreover, the above perfluorinated organic compounds feature a small dielectric loss factor (tan $\alpha$) up to frequencies of about 100 MHz by virtue of which the resistor possesses excellent high-frequency parameters.

It is advisable that the sectionalized bobbin be formed of poly(2,6-dimethylphenyleneoxide).

It is advisable that the sectionalized bobbin be formed of polyformaldehyde.

It is also advisable that the sectionalized bobbin be formed of celsian ceramics.

Apart from having excellent dielectric properties, the aforementioned plastics poly(2,6-dimethylphenyleneoxide) and polyformaldehyde, as well as celsian ceramics offer another important property. They remain totally unaffected by the chemical impact exercised by the liquid perfluorinated organic compounds and, specifically, by the mixture comprised of perfluoro-n-butyl-tetrahydro-furan and perfluoro-n-propyl-pyran and also by perfluoro-di-n-butyl ether which are reputed to be chemically inert in regard to non-metals.

Due to this fact the sectionalized bobbin made from the materials as mentioned hereinabove affords an increase in the resistor long time stability.

With these and other objects of the present invention in view, there is also proposed a method of making a heavy-duty precision wire-wound alternating-current resistor, comprising the steps of winding a high-resistance insulated wire forming a resistance element onto a sectionalized bobbin, arranging the bobbin within a capsule, and filling same with a liquid dielectric. According to the invention, prior to winding, the bobbin is coated with a layer of a sublimable substance which is removed subsequent to winding by means of vacuum treatment providing thereby a clearance between the sectionalized bobbin and the resistance element.

As was shown hereinabove, the provision of the clearance between the sectionalized bobbin and the resistance element is of paramount importance to the resistor design. The fabrication of the resistor with such a clearance between the sectionalized bobbin and the resistance element designed in the form of a winding whose wire has a diameter of a few tens of microns is made feasible only by means of applying to the sectionalized bobbin a solid coat of some substance removable after the winding of the resistance element. In this case, a means for removing this solid coating should have any mechanical or chemical effects on the wire of the resistance element. This is only the proposed design that makes it possible to produce the resistor with a clearance between the sectionalized bobbin and the resistance element complying with the abovespecified requirements.

It is advisable that the sublimable substance be comprised of a quick-drying solution of dimethylterephthalate in xylene with an addition of benzophenone, having the following component ratio (in percent by weight):

dimethylterephthalate: 8 to 12
benzophenone: 0.8 to 1.2
xylene: remainder

It is advisable that the sublimable substance be comprised of a quick-drying solution of anthracene in xylene, having the following component ratio (in percent by weight):

anthracene: 3 to 6
xylene: remainder

The above substances, at the specified component ratio, when applied to the sectionalized bobbin, produce a quick-drying fine-grained coating with good adhesion to the material and a satisfactory mechanical durability. Under normal conditions this coating may keep on practically to any desired length of time. Upon vacuum treatment the coating consisting of these substances volatilizes readily and completely.

The stated range of the component ratio of the quick-drying solutions is selected on the basis of the following considerations verified experimentally:

the content by weight of less than 8% of dimethylterephthalate and less than 0.8% of benzophenone in the solution, and also with the content by weight of less than 3% of anthracene in the solution, the solutions prove to be too fluid. So in order to obtain a solid coat of the sublimable substance of the required thickness on the surface of the sectionalized bobbin of the resistance element multiple application of these solutions is necessary, which significantly increases the time taken for obtaining the desired solid coat.

With the content by weight of more than 12% of dimethylterephthalate and more than 1.2% of benzophenone in the solution, and also with the content by weight of more than 6 wt % of anthracene in the solution, the grain size of the solid coat of the sublimable substance being formed increases. This phenomenon is undesirable in view of the fact that while winding the wire of the resistance element, having a diameter of the order of a few tens of microns, onto such a coat the wire may become damaged.

BRIEF DESCRIPTION OF THE DRAWINGS

The foregoing and other objects as well advantages of the present invention will be more apparent from the succeeding detailed description of embodiments thereof with reference being made to the accompanying drawings, in which.

DETAILED DESCRIPTION OF THE INVENTION

Figure 1:
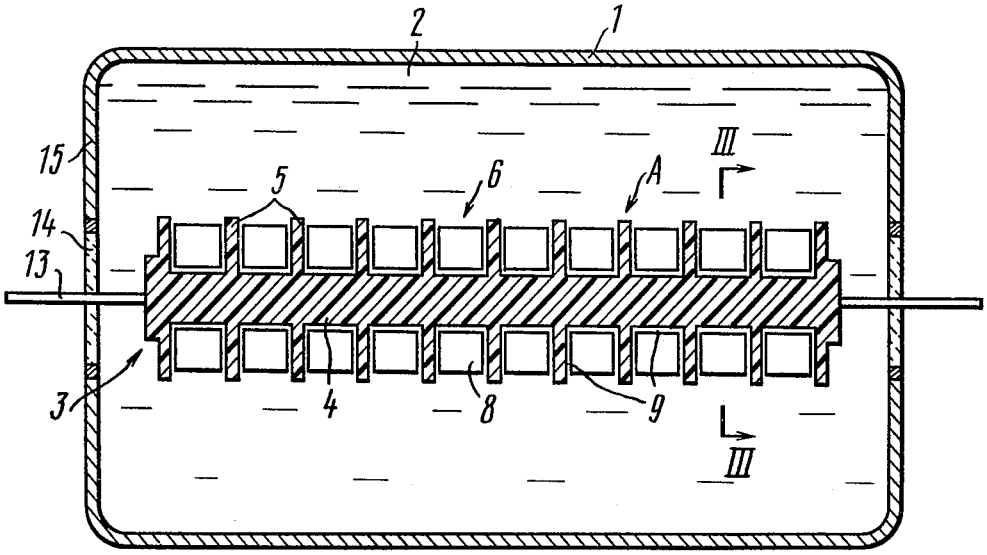
FIG. 1 is a longitudinal sectional view illustrating a heavy-duty precision wire-wound alternating-current resistor, in accordance with the invention.

The heavy-duty precision wire-wound alternating-current resistor comprises a metallic capsule 1 (FIG. 1) made of a high heat-conductivity metal, such as copper. The capsule 1 is filled with a liquid dielectric 2 formed of a perfluorinated organic compound having excellent dielectric properties combined with high fluidity. Within the capsule 1 there is arranged a sectionalized bobbin 3 designed in the form of a cylindrical core 4 with flanges 5. The sectionalized bobbin 3 is made of a material chemically resistant to the liquid perfluorinated organic compound. The sectionalized bobbin 3 carries a resistance element 6 designed in the form of a winding of a high-resistance insulated wire 7 (FIG. 2) divided into sections 8. Between the sections 8 of the resistance element 6 and the sectionalized bobbin 3, and between its cylindrical core 4 and flanges 5, there is provided a clearance 9 dimensioned so that it exceeds by at least an order of magnitude the thermal expansion taking place in the material of the sectionalized bobbin 3. The clearance 9 excludes the mechanical effect of the sectionalized bobbin 3, upon its unavoidable thermal expansion in the process of operation, on the wire 7 of the resistance element 6, which eventually enhances the resistor's time stability. The provision of the clearance 9 enables the liquid dielectric 2, serving as a cooling agent, to circulate unimpededly between the sectionalized bobbin 3 and the resistance element 6, in which case the area of the surface of the resistance element 6 being cooled approximately trebles as distict from the prior art resistors wherein the wire of the resistance element is snugly wound onto the sectionalized bobbin, with other things being equal.

Figure 3:
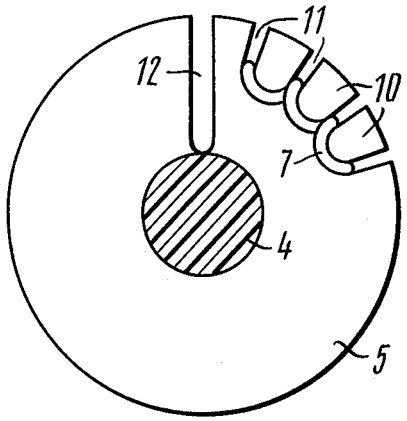
FIG. 3 is a cross sectional view taken along the line III—III of FIG. 1.
Figure 4:
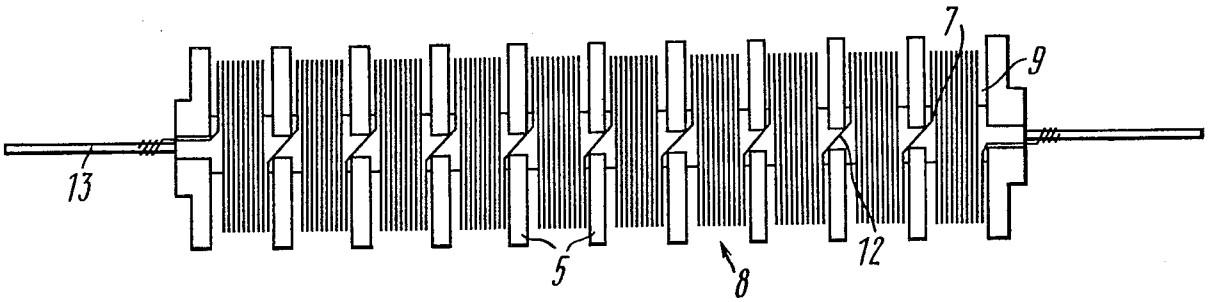
FIG. 4 is a top view of a sectionalized bobbin with a resistance element arranged thereon.

To decrease the reactance of the resistance element 6 each of its sections 8 (FIG. 2) has a sequentially alternating direction of winding the layers of the wire 7, whereas in the adjacent sections 8 the layers with an opposite direction of winding have a staggered order of arrangement. To change the direction of winding the wire 7 upon its passing from one layer to the other within the sections 8 there are provided lugs 10 (FIG. 3) formed by slots 11 in the flanges 5 of the sectionalized bobbin 3. To enable the wire 7 to pass from one section 8 to the other there is provided a slot 12 (FIG. 4) extending through all of the flanges 5 of the sectionalized bobbin 3. The sectionalized bobbin 3 (FIG. 1) with the resistance element 6 arranged thereon is positioned within the capsule 1 by means of leads 13 of the resistance element 6 extending through feedthrough insulators 14 arranged in the side walls 15 of the capsule 1. The feedthrough insulators 14 are made of a material chemically resistant to the liquid perfluorinated organic compound, for instance, celsian ceramics or glass. As was shown hereinabove, the capsule 1 is filled with the liquid dielectric 2 consisting of a liquid perfluorinated organic compound featuring high dielectric and thermal properties. It is preferable to utilize in the resistor such perfluorinated organic compounds as a mixture of perfluoro-di-n-butyl-tetrahydrofuran and perfluoro-n-propyl-pyran having exclusively high dielectric and thermal properties. The electric strength of this mixture reaches up to 250 kV/cm, while its volume resistance is up to $10^{14}$ ohm/cm$^3$. This creates a high level of insulation of the resistance element 6, that also ensures a high electric breakdown voltage of the resistor. The above mixture has a very low dielectric loss factor (tan $\alpha=2\times10^{-4}$ at frequencies up to 300 MHz), which endows the resistor with excellent high frequency parameters. The mixture of perfluroro-di-n-butyl-tetrahydrofuran and perfluoro-n-propyl-pyran offering low viscosity has a heat capacity as great as hundreds of kcal/m$^3$, which in combination with the large area of the resistance element 6 being cooled provides for its excellent cooling. This mixture, in the operating temperature range of the resistor ranging from −60° to +60° C., is far from its boiling temperature which is about equal to +101.4° C. This results in the absence of admissible pressure within the capsule 1 of the resistor, which in turn makes it possible to manufacture the capsule 1 with thin walls and, as a consequence, to decrease the weight and dimensions of the resistor as well as to improve the transfer of heat from the resistance element 6 to the environment.

The mixture is also far from its freezing temperature equal to −110° C. Such a perfluorinated organic compound as perfluoro-di-n-butyl ether is close in its parameters to the aforesaid mixture, and may be also advantageously employed in the given resistor.

It is clearly understood that the liquid dielectric of the resistor may be formed of some other perfluorinated organic compounds having sufficiently high dielectric and thermal properties.

As indicated by experiments, some of the liquid perfluorinated organic compounds, and in particular those considered hereinabove, are agressive to most of the plastics which have the widest application as structural materials of the resistor components. Some plastics therewith become dissolved while others under the effect of these compounds become swollen.

If such a bobbin is subject even to the slightest dissolution under the influence of the liquid perfluorinated organic compounds hydrogen-containing compounds appear in the liquid dielectric, which in case of a high voltage drop at the resistor leads to the process of electrolysis. As a result, hydrofluoric acid is formed and causes corrosion in the wire of the resistance element with the consequent changes in its resistance value. In other words, this decreases the resistor's time stability.

When the capsule starts swelling, it causes mechanical stresses in the wire of the resistance element, thus causing a variation in its resistance. Therefore, if the capsule becomes swollen, the resistor's time stability also drops. To obtain a complete insolubility and absence of swelling it is necessary to employ plastics which would be chemically different from these compounds. Thus, such non-polar mixtures as the mixture of perfluoro-di-n-butyl-tetrahydro-furan and perfluoro-n-propyl-pyran, or else perfluoro-di-n-butyl ether, will be neutral to the plastics made of a polar monomer and not containing low molecular components. The number of such plastics is rather limited, especially considering the fact that they should also possess excellent dielectric properties at the same time.

With due regard to the foregoing considerations the present invention uses as a structural material of the sectionalized bobbin 3 poly(2,6-dimethylphenylenoxide). Besides poly(2,6-dimethylphenyleneoxide), polyformaldehyde may be also advantageously used. Both of these plastics are not subject to attack by perfluorinated organic compounds and at the same time feature excellent dielectric properties. The utilization of the above substances enhances the resistor's time stability. As a structural material of the sectionalized bobbin 3, apart from the stated plastics, ceramics may equally well be used.

Figure 5:
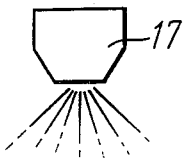
FIG. 5 illustrates the process of applying a layer of a sublimable substance to the sectionalized bobbin.
Figure 5:
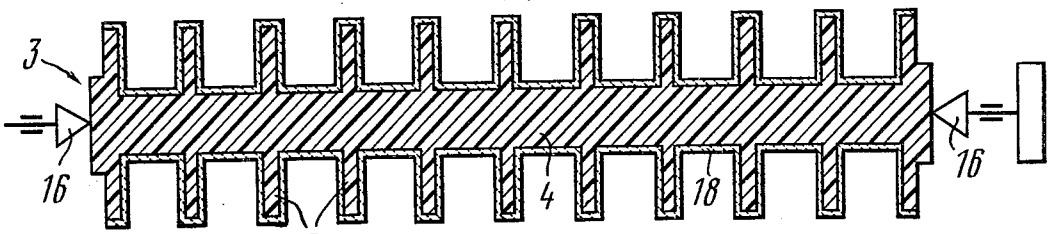

The method of fabricating a heavy-duty wire-wound resistor consists in the following. The sectionalized bobbin 3 (FIG. 5) is secured between supports 16 of a rotating device and is brought to rotation at a speed of 100 rev/min. In a number of stages a layer 18 of a sublimable substance is applied to the surface of the cylindrical core 4 and the flanges 5 of the sectionalized bobbin 3, which is effected by means of a sprayer 17. The thickness of the layer 18 of a sublimating substance is equal to the magnitude of the clearance 9 (FIG. 2) between the resistance element 6 and the sectionalized bobbin 3. The sublimating substance is a quick-drying solution of dimethylterephthalate in xylene with the addition of benzophenone, having the following component ratio (in percent by weight):

dimethylterephthalate: 8 to 12
benzophenone: 0.8 to 1.2
xylene: remainder or a quick-drying solution of anthracene in xylene, having the following component ratio:

anthracene: 3 to 6
xylene: remainder

The layer 18 (FIG. 5) of the sublimable substance such as a quick-drying solution of dimethylterephthalate in xylene, or a solution of anthracene in xylene, within the stated ranges of the component ratio, upon drying has a fine-grained structure, good adhesion to the material of the bobbin and high mechanical durability.

The specified range of the component ratio is selected on the basis of the following considerations verified experimentally:

with a content by weight of less than 8% of dimethylterephthalate and less than 0.8% of benzophenone in the solution, as well as with a content by weight of less than 3% of anthracene, in the solution the solutions prove to be too fluid. So in order to obtain a solid layer of the sublimable substance of the required thickness on the surface of the sectionalized bobbin of the resistance element multiple application of these solutions is necessary, which significantly increases the time taken for obtaining this solid layer;

with a content by weight of more than 12% of dimethylterephthalate and more than 1.2% of benzophenone in the solution, as well as with a content by weight of more than 6% of anthracene, the grain size of the solid layer of the sublimating substance, being formed of these solutions, increases. This phenomenon is undesirable because, when winding the wire of the resistance element, having a diameter of the order of a few tens of microns, onto such a layer the wire may become damaged.

The optimum properties of the layer, 18 of the sublimable substance can be provided with use of a quick-drying solution of dimethylterephthalate in xylene with the addition of benzophenone, having the following component ratio (in percent by weight):

dimethylterephthalate: 10
benzophenone: 1.0
xylene: remainder or a quick-drying solution of anthracene in xylene, having the following component ratio (in percent by weight):

anthracene: 4
xylene: remainder

Figure 2:
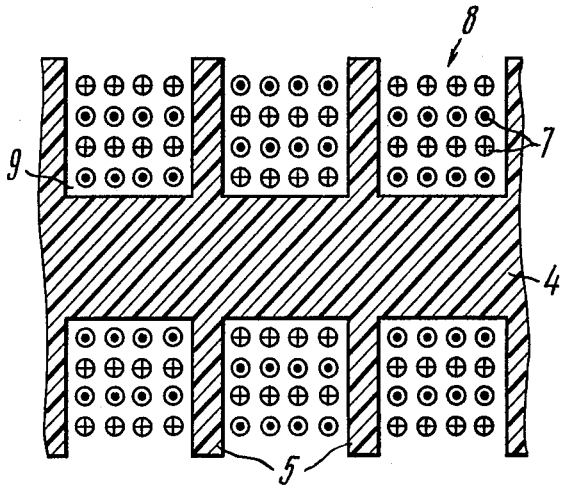
FIG. 2 is an enlarged view taken in the direction of arrow A in FIG. 1.

Subsequent to the application of the layer 18 (FIG.5) of the sublimating substance to the surface of the sectionalized bobbin 3, the bobbin 3 is set on a winding device (not shown). With the help of the winding device is produced the winding of the resistance element 6 which is illustrated in FIG. 2. The sectionalized bobbin 3 with the resistance element 6 wound thereon is placed in a vacuum chamber (not shown) and exposed to vacuum treatment at a pressure of not more than 1 mm Hg at a temperature of 60° C. for an hour. As a result, the layer 18 of the sublimable substance completely evaporizes off the surface of the sectionalized bobbin 3 and the clearance 9 is formed between it and the resistance element 6. The sectionalized bobbin 3 is arranged within the capsule 1 of the resistor and is secured as shown in FIG. 1. Thereupon the capsule I of the resistor is filled with the liquid dielectric 2.

It is clearly understood that the resistor of this construction may be manufactured by the aforedescribed method with any combination of the foregoing materials of the sectionalized bobbin and liquid dielectrics.

As an example, below is presented essential data on the heavy-duty precision wire-wound alternating-current resistor fabricated in accordance with the method as outlined hereinabove.

Resistor capsule: material-copper; overall dimensions—40×40×70 mm. Sectionalized bobbin: material-poly (2,6-dimethylphenyleneoxide); number of sections—24.

Resistance element: number of sections—24; wire turns per section—600; wire—high-resistance, insulated, 30 microns in diameter.

Dimension of clearance between the sectionalized bobbin and the resistance element: 0.2 mm.

Liquid dielectric - mixture of perfluoro-di-n-butyltetrahydro-furan and perfluoro-n-propyl-pyran.

Resistor operating voltage: 1.2 kV;
Resistor wattage: 3 W
Resistance: 500 Kohm
Accuracy: 0.01%
Resistance temperature coefficient: $5\times10^{-7}$ A comparison of the major performance data of the proposed heavy-duty precision wire-wound alternating-current resistor with that of the best analogous resistors existing in the world today is presented in the appended table.

From the specific embodiments of the present invention disclosed hereinabove it is perfectly apparent to those skilled in the art that all of the objects of the invention within the scope defined by the appended claims are achievable. It is also perfectly apparent that some modifications and variations may be made in the structure of the resistor as well as in the steps of the method of fabricating the same without departing from the spirit of the invention. All such modifications and variations are considered to be well within the spirit and scope of the invention as recited in the succeeding claims.

The proposed heavy-duty precision wire-wound alternating-current resistor features a simultaneous combination of the major parameters that are equally high, which is accomplished due to its construction in conjunction with the exclusively high physical and chemical properties of the materials of the components thereof. The resistor offers high wattage values together with high time stability, accuracy and miniature size. It has a low reactance value and can be applied at high frequencies without any loss in accuracy.

The method of making this resistor is technologically efficient and can be readily adapted for full-scale production of resistors.

TABLE

| Country 1 | Company 2 | Type 3 | Resistance R 4 | Wattage P 5 | Operating voltage $U_{max}$ 6 | Accuracy % 7 | Operating frequency 8 | Time stability % 9 | Resistance temperature coefficient 10 | Note 11 |
|---|---|---|---|---|---|---|---|---|---|---|
| USSR | Proposed resistor | | 300kOhms to 500kOhms | 3 W | 1.2 kV | 0.01% | 100 kHz | 0;0.01% per 100 hours at P=3W | $0.6\times10^{-7}$ 1/°C. | Precision Wire-Wound Resistor |
| U.S.A. | Allen-Bradley | FN130 | 1 kOhm to 2MOhms | 25mW | 20 V | ±0.01% | $\tau<100$ns | — | $\pm25\times10^{-6}$ 1/°C. | Precision Thin Film Resistor Networks |
| U.S.A. | Vishay-Resistive System Group | S106C | 120 Ohms to 600 kOhms | 1 W | 500V | ±0.005 to 1% | — | 0.03% per 2000 hours at $P_{max}$=0.3W | $\pm1\times10^{-6}$ 1/° C. | Vishay precision Resistor |
| Great Britain | Muirhead | RB40B RB40C | 1 kOhm to 3 MOhms | 1.5 W | 1.2 kV | ±0.01% | $\tau=150$s | — | $\pm5\times10^{-6}$ 1/°C. | Precision Wire-Wound Resistors |
| Great Britain | Dubilier | WW-2 | 1 Ohm to | 2W | 2000V | ±0.25% | — | — | $+22\times10^{-6}$ 1/°C. | Precision Wire-Wound |

TABLE-continued

| Country 1 | Company 2 | Type 3 | Resistance R 4 | Wattage P 5 | Operating voltage $U_{max}$ 6 | Accuracy % 7 | Operating frequency 8 | Time stability % 9 | Resistance temperature coefficient 10 | Note 11 |
|---|---|---|---|---|---|---|---|---|---|---|
| Switzerland | Tettex | 7140 | 5 MOhms 100 kOhms to 500 kOhms | 1.5W | 1000V | ±0.05% | — | — | $1 \times 10^{-5}$ 1/°C. | Resistors Single Precision Resistance |
| Holland | Philips | E192 series | 1 Ohm to 57 kOhms | 1.8 W | — | ±0.25% | — | — | $20 \times 10^{-6}$ 1/°C. | Precision Wire-Wound Resistors |
| FRG | Deutsche Vitrohm GmbH & Co KG | CEC | 10 Ohms | 0.5 W | 350V | ±1% | — | — | $5000 \times 10^{-4}$ 1/°C. | Vitrohm metal film Resistors |
| Japan | Koa-Denko | Ultra series | 500Ohms max | 3 W | — | — | — | — | $-2.5 \times 10^{-4}$ 1/°C. | Low Temperature Coefficient Resistors |
| France | Sfernice | RFP-100 | 50 Ohms to 4 MOhms | 1 W | — | ±0.1% | — | — | $\pm 20 \times 10^{-6}$ 1/°C. | Resistances Fixes Bobinées de Précision |
| Rumania | Electronum | RBC1003 to RBC1008 | 1 Ohm to 39 kOhms | 3 W to 8 W | — | ±5% | — | — | $200 \times 10^{-6}$ 1/°C. | Wire-Wound Cemented Resistors |

What is claimed is:

1. A heavy-duty precision wire-wound alternating-current resistor comprising:

a capsule;

a liquid dielectric formed of a low-viscosity liquid perfluorinated organic compound and provided for filling said capsule;

a sectionalized bobbin arranged within said capsule and made from an insulating material being chemically resistant to said liquid perfluorinated organic compound; and a resistance element arranged on said sectionalized bobbin with a clearance therebetween, said clearance being dimensioned so as to exceed by at least an order of magnitude the change in the bobbin diameter due to the thermal expansion of the material of said sectionalized bobbin, said resistance element being made in the form of a high-resistance insulated wire winding.

2. A heavy-duty precision wire-wound alternating-current resistor as recited in claim 1, wherein said liquid perfluorinated organic compound is formed of a mixture including perfluoro-n-butyl-tetrahydro-furan and perfluoro-n-propylpyran.

3. A heavy-duty precision wire-wound alternating-current resistor as recited in claim 1, wherein said liquid perfluorinated organic compound is formed of perfluoro-di-n-butyl ether.

4. A heavy-duty precision wire-wound alternating-current resistor as recited in claim 1, wherein said sectionalized bobbin is made from poly(2,6-dimethylphenyleneoxide).

5. A heavy-duty precision wire-wound alternating-current resistor as recited in claim 2, wherein said sectionalized bobbin is made from poly(2,6-dimethylphenyleneoxide).

6. A heavy-duty precision wire-wound alternating-current resistor as recited in claim 3, wherein said sectionalized bobbin is made from poly(2,6-dimethylphenyleneoxide).

7. A heavy-duty precision wire-wound alternating-current resistor as recited in claim 1, wherein said sectionalized bobbin is made from polyformaldehyde.

8. A heavy-duty precision wire-wound alternating-current resistor as recited in claim 2, wherein said sectionalized bobbin is made from polyformaldehyde.

9. A heavy-duty precision wire-wound alternating-current resistor as recited in claim 3, wherein said sectionalized bobbin is made from polyformaldehyde.

10. A hevy-duty precision wire-wound alternating-current resistor as recited in claim 1, wherein said sectionalized bobbin is made from celsian ceramics.

11. A heavy-duty precision wire-wound alternating-current resistor as recited in claim 2, wherein said sectionalized bobbin is made from celsian ceramics.

12. A heavy-duty precision wire-wound alternating-current resistor as recited in claim 3, wherein said sectionalized bobbin is made from celsian ceramics.

13. A method of making a heavy-duty precision wire-wound alternating-current resistor comprising the steps of:

coating a sectionalized bobbin with a layer of a sublimable substance;

winding a high-resistance insulated wire forming a resistance element onto said sectionalized bobbin;

removing said layer of said sublimable substance from said sectionalized bobbin by means of vacuum treatment, thereby providing a clearance between said sectionalized bobbin and said resistance element;

fixing said sectionalized bobbin within a capsule of the resistor; and filling said capsule with a liquid dielectric.

14. A method of making a heavy-duty precision wire-wound resistor as recited in claim 13, wherein said sublimable substance is comprised of a quick-drying solution of dimethylterephthalate in xylene with an addition of benzophenone, having the following component ratio (in percent by weight):

dimethylterephthalate: 8 to 12 benzophenone: 0.8 to 1.2
xylene: remainder

15. A method of making a heavy-duty precision wire-wound resistor as recited in claim 13, wherein said sublimable substance is comprised of a quick-drying solution of anthracene in xylene, having the following component ratio (in percent by weight):

anthracene: 3 to 6
xylene: remainder

* * * * *